US012370590B2

(12) United States Patent
Arzel et al.

(10) Patent No.: US 12,370,590 B2
(45) Date of Patent: Jul. 29, 2025

(54) EXTRUSION SYSTEM INCLUDING A PRESS AND AN EXTRUSION DIE WITH TWO MUTUALLY-PERPENDICULAR DIRECTIONS OF MOVEMENT

(71) Applicant: Airbus Operations SAS, Toulouse (FR)

(72) Inventors: Bruno Arzel, Toulouse (FR); Alice Raquin, Toulouse (FR)

(73) Assignee: AIRBUS OPERATIONS SAS, Toulouse (FR)

( * ) Notice: Subject to any disclaimer, the term of this patent is extended or adjusted under 35 U.S.C. 154(b) by 270 days.

(21) Appl. No.: 18/159,395

(22) Filed: Jan. 25, 2023

(65) Prior Publication Data

US 2023/0241658 A1 Aug. 3, 2023

(30) Foreign Application Priority Data

Jan. 28, 2022 (FR) ..... 2200736

(51) Int. Cl.

| | |
|---|---|
| ***B21C 23/08*** | (2006.01) |
| ***B21C 23/00*** | (2006.01) |
| ***B21C 23/21*** | (2006.01) |
| ***B30B 1/10*** | (2006.01) |
| ***B30B 1/24*** | (2006.01) |
| ***B30B 11/26*** | (2006.01) |

(52) U.S. Cl.
CPC ..... *B21C 23/08* (2013.01); *B21C 23/002* (2013.01)

(58) Field of Classification Search
CPC ..... B21C 23/08; B21C 23/002; B21C 23/211; B30B 1/24; B30B 1/10
See application file for complete search history.

(56) References Cited

U.S. PATENT DOCUMENTS 1,836,763 A * 12/1931 Liebergeld ..... B21C 23/211 72/271
2,753,994 A 7/1956 Bridge
(Continued)

FOREIGN PATENT DOCUMENTS

CN 112588858 A 4/2021
DE 542001 C 1/1932
DE 567106 C 12/1932
(Continued)

OTHER PUBLICATIONS

English translate (WO2013168981A1), retrieved date Nov. 11, 2024.*
(Continued)

*Primary Examiner* — Mohammed S. Alawadi
(74) *Attorney, Agent, or Firm* — Greer, Burns & Crain, Ltd.

(57) ABSTRACT

An extrusion system including a press with a chassis, a slider mounted to be mobile vertically on the chassis and an actuating arrangement that moves the slider, a hollow container receiving a billet and having at one end an extrusion die and at the other end a piston mobile in translation horizontally in the container, and a movement transformation system arranged between the slider and the piston to transform the vertical movement in translation of the slider into horizontal movement in translation of the piston. With an arrangement of this kind, it is possible to use a press of higher power.

6 Claims, 4 Drawing Sheets

(56) References Cited

U.S. PATENT DOCUMENTS

| | | | | | |
|---|---|---|---|---|---|
| 4,155,300 | A * | 5/1979 | Baltschun | ..... | B30B 1/42<br>100/270 |
| 2022/0388265 | A1 * | 12/2022 | Henderson, Jr. | ..... | B30B 9/00 |

FOREIGN PATENT DOCUMENTS

| | | | | | |
|---|---|---|---|---|---|
| IT | 201900015812 | A1 | 3/2021 | | |
| JP | 2016163901 | A | 9/2016 | | |
| KR | 101924693 | B1 * | 12/2018 | | |
| WO | WO-2013168981 | A1 * | 11/2013 | ..... | B21C 1/28 |

OTHER PUBLICATIONS

English translate (KR101924693B1), retrieved date Nov. 11, 2024.*
French Search Report dated Sep. 8, 2022; priority document.

* cited by examiner

EXTRUSION SYSTEM INCLUDING A PRESS AND AN EXTRUSION DIE WITH TWO MUTUALLY-PERPENDICULAR DIRECTIONS OF MOVEMENT

CROSS-REFERENCES TO RELATED APPLICATIONS

This application claims the benefit of the French patent application No. 2200736 filed on Jan. 28, 2022, the entire disclosures of which are incorporated herein by way of reference.

FIELD OF THE INVENTION

The present invention relates to the general field of extrusion systems, in particular for the extrusion of metal, for example aluminum, billets. It concerns, in particular, an extrusion system including a press, in particular a forging press, and an extrusion die that has two mutually-perpendicular directions of movement.

BACKGROUND OF THE INVENTION

FIG. 6 shows a prior art extrusion system 600. The extrusion system 600 includes a container 602 that is hollow and enables reception of a billet 604, for example an aluminum billet. At one of the ends of the container 602 is disposed an extrusion die 606 that has a passage 608 through which the extruded profile 610 passes.

At the other end of the container 602 a piston 612 is mounted to be mobile in translation in the container 602. The piston 612 is moved by a horizontal displacement press that is outside the container 602 and has a piston rod 614 secured to the piston 612.

The operation of an extrusion system 600 of this kind is then as follows. A heated billet 604 is introduced into the container 602 between the piston 612 and the extrusion die 606. The press moves the piston 612 toward the extrusion die 606, which pushes the billet 604 through the extrusion die 606 to form the extruded profile 610.

Although an arrangement of this kind offers high performance, the presses employed have limited power and it is therefore necessary to find an arrangement that enables higher powers to be obtained.

SUMMARY OF THE INVENTION

An object of the present invention is to propose an extrusion system that has a high thrust power, in particular due to the use of a vertical axis press and a horizontal axis die.

To this end there is proposed an extrusion system including:

- a press with a chassis, a slider that is mounted to be mobile vertically on the chassis and actuating means that move the slider alternately downward and upward,
- at least one container that is hollow to receive a billet and has at one of its ends an extrusion die and at the other of its ends a piston mounted to be mobile in translation horizontally in the container, and
- for each piston a movement transformation system that is arranged between the slider and the piston to transform the vertical movement in translation of the slider into horizontal movement in translation of the piston.

With an arrangement of this kind, it is possible to use a press of higher power.

In accordance with one particular embodiment, each movement transformation system includes a pinion the rotation axis of which is horizontal and perpendicular to the direction of movement in translation of the piston, a first rack that meshes with the pinion and is secured to the slider, and a second rack that meshes with the pinion and is secured to said piston.

There is advantageously only one piston, and the second rack advantageously meshes with a lower part of the pinion.

There are advantageously two pistons and each second rack advantageously meshes with a lower part of the pinion.

There are advantageously two pistons and one of the second racks advantageously meshes with a lower part of the pinion and the other of the second racks advantageously meshes with an upper part of the pinion.

In accordance with one particular embodiment, each movement transformation system includes an arm that has a first end mounted in articulated manner on the slider and a second end mounted in articulated manner on the piston.

BRIEF DESCRIPTION OF THE DRAWINGS

The features of the invention mentioned hereinabove and others will become more clearly apparent on reading the following description of one embodiment, said description being given with reference to the appended drawings, in which.

DETAILED DESCRIPTION OF THE PREFERRED EMBODIMENTS

Figure 1:
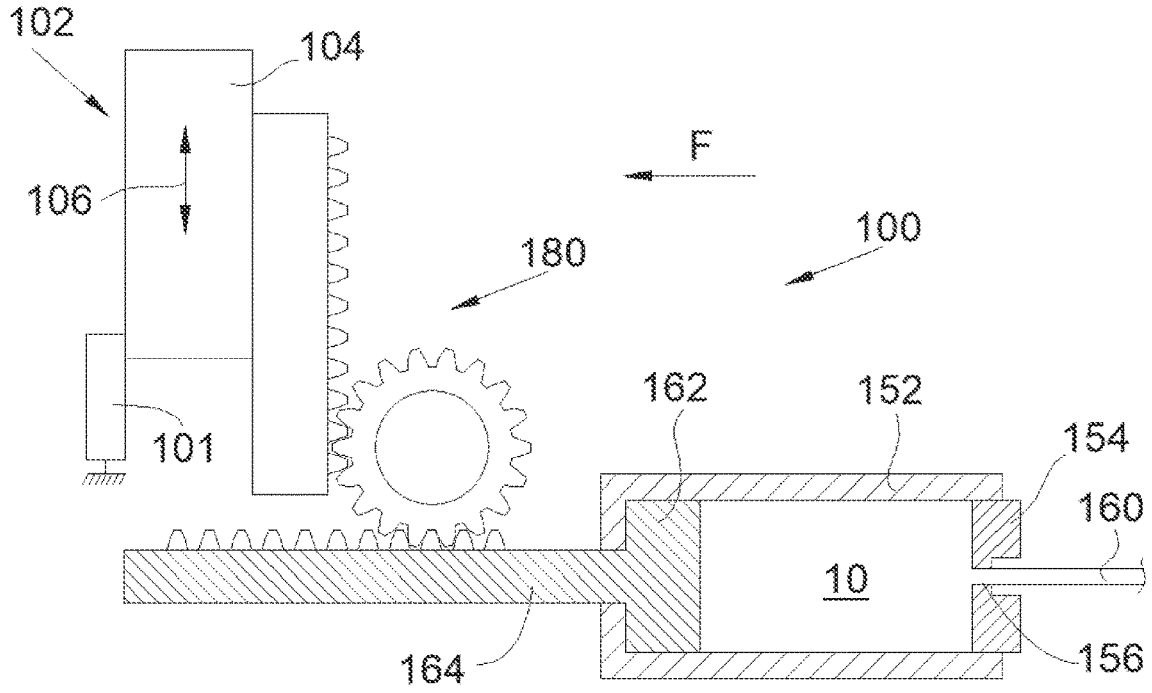
FIG. 1 is a diagrammatic representation of an extrusion system in accordance with a first embodiment of the invention.
Figure 5:
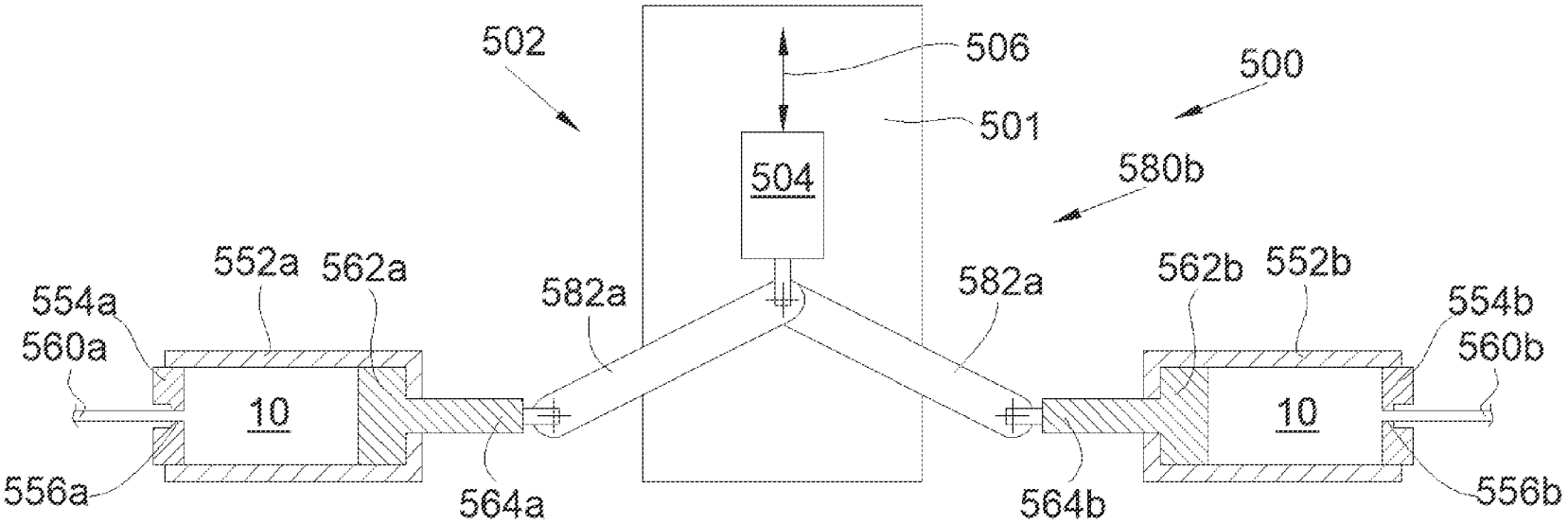
FIG. 5 is a diagrammatic representation of an extrusion system according to a second embodiment of the invention, and FIG. 6 already described, is a diagrammatic representation of a prior art extrusion system.
Figure 6:
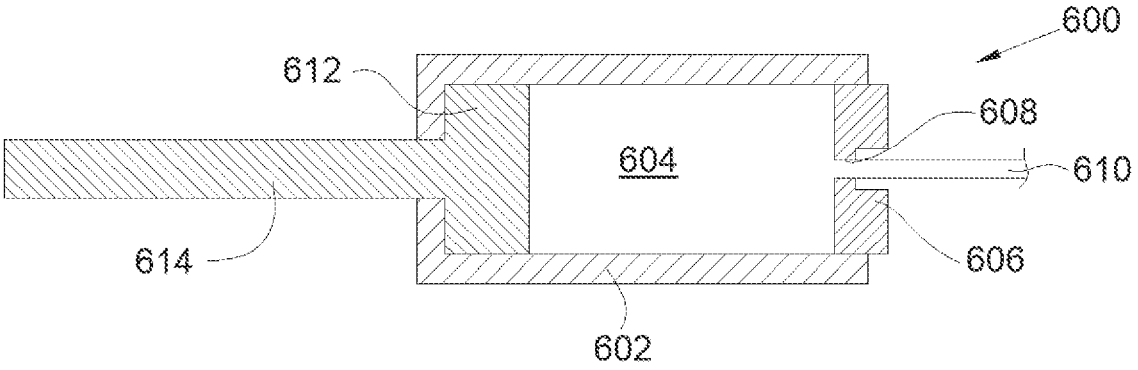
Fig. 6 Prior Art

FIG. 1 shows an extrusion system 100 according to a first embodiment of the invention and FIG. 5 shows an extrusion system 500 according to a second embodiment of the invention.

The extrusion system 100, 500 includes a press 102, 502 with a chassis 101, 501 and a slider 104, 504 that is mounted to be mobile vertically on the chassis 101, 501. The movement in translation of the slider 104, 504 on the chassis 101, 501 is guided by any guide means known to the person skilled in the art, such as guide rails, for example.

The press 102, 502 also includes actuating means 106, 506 that move the slider 104, 504 vertically and alternately downward and upward. The actuating means 106, 506 are for example of the mechanical type with a crank and link system or of the hydraulic type or of the screw type.

The press 102, 502 is advantageously a forging press the slider 104, 504 of which moves vertically and has a varying much higher power than the horizontal axis presses of the prior art extrusion systems.

The extrusion system 100, 500 also includes at least one container 152, 552*a-b* that is hollow and enables it to receive a billet 10, for example an aluminum billet. At one of the ends of the container 152, 552*a-b* is disposed an extrusion die 154, 554*a-b* that includes a passage 156, 556*a-b* through which the extruded profile 160, 560*a-b* passes.

At the other end of the container 152, 552*a-b* a piston 162, 562*a-b* is mounted to be mobile in translation in the container 152, 552*a-b*. The piston 162, 562*a-b* is extended outside the container 152, 552*a-b* by a piston rod pinion, 564*a-b*. The end at which the extrusion die 154, 554*a-b* is disposed is opposite the end at which the piston 162, 562*a-b* and the piston rod 164, 564*a-b* are disposed.

Each piston 162, 562*a-b* is mobile horizontally, that is to say, perpendicularly to the direction of movement of the slider 104, 504.

The extrusion system 100, 500 also includes, for each piston 162, 562*a-b*, a movement transformation system 180, 580*a-b* that is arranged between the slider 104, 504 and the piston 162, 562*a-b* and more particularly the piston rod 164, 564*a-b* secured to the piston 162, 562*a-b*, to transform the movement in translation of the slider 104, 504 in the vertical direction into movement in translation of the piston 162, 562*a-b* in the horizontal direction.

The operation of an extrusion system 100, 500 of this kind is then as follows. A heated billet is introduced into the container 152, 552*a-b* between the piston 162, 562*a-b* and the extrusion die 154, 554*a-b*. By means of the actuating means 106, 506 the press 102, 502 moves the slider 104, 504 vertically, here downward, and the movement transformation system 180, 580*a-b* transforms the movement of the slider 104, 504 into movement of the piston 162, 562*a-b* toward the extrusion die 154, 554*a-b*, which pushes the billet 10 through the passage 156, 556*a-b* of the extrusion die 154, 554*a-b* to form the extruded profile 160, 560*a-b*.

An arrangement of this kind enables use of a vertical displacement press that is of high power.

Thus, the slider 104, 504 is mobile between a first position corresponding to a position of the piston 162, 562*a-b* away from the extrusion die 154, 554*a-b* and a second position corresponding to a position of the piston 162, 562*a-b* close to the extrusion die 154, 554*a-b*.

In the embodiment of the invention shown in FIGS. 1 and 5, the downward vertical movement of the slider 104, 504 drives the movement of the piston 162, 562*a-b* toward the extrusion die 154, 554*a-b*, but if the press 102, 502 is disposed lower than the container 152, 552*a-b*, it is upward vertical movement of the slider 104, 504 that drives the movement of the piston 162, 562*a-b* toward the extrusion die 154, 554*a-b*.

Figure 2:
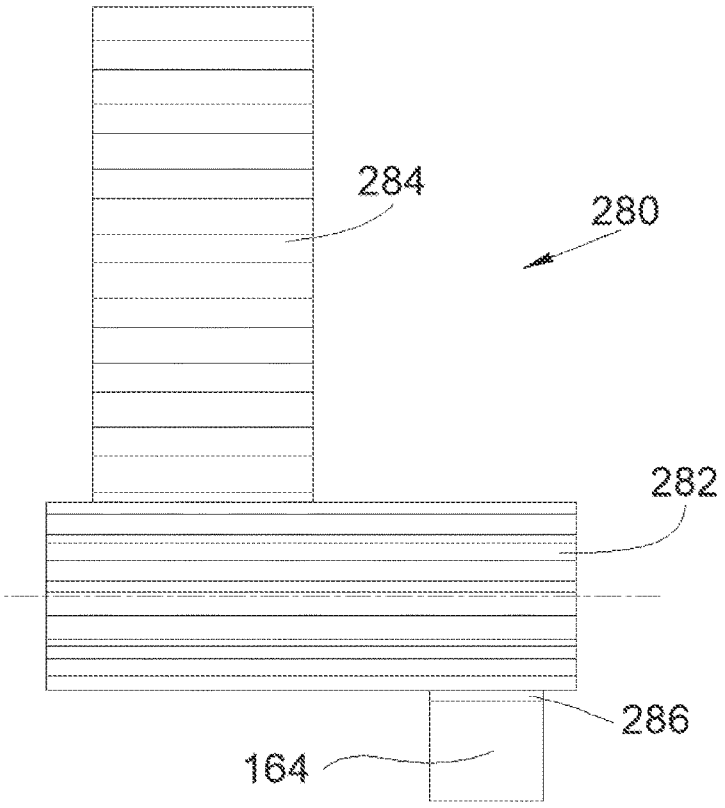
FIG. 2 is a view in the direction of the arrow F in FIG. 1 for a first variant of the first embodiment of the invention.
Figure 3:
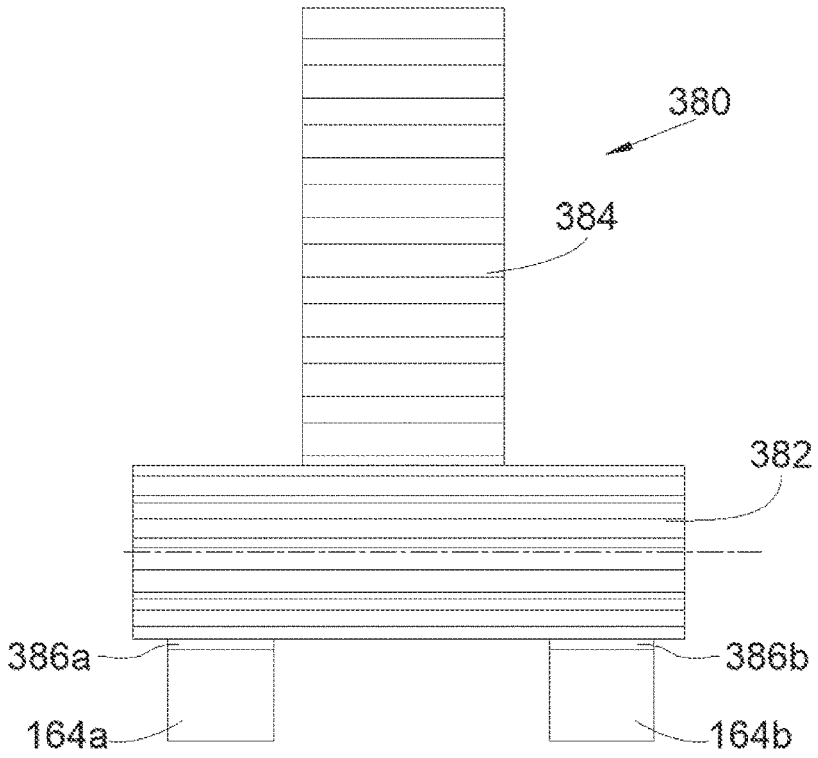
FIG. 3 is a view in the direction of the arrow F in FIG. 1 for a second variant of the first embodiment of the invention.
Figure 4:
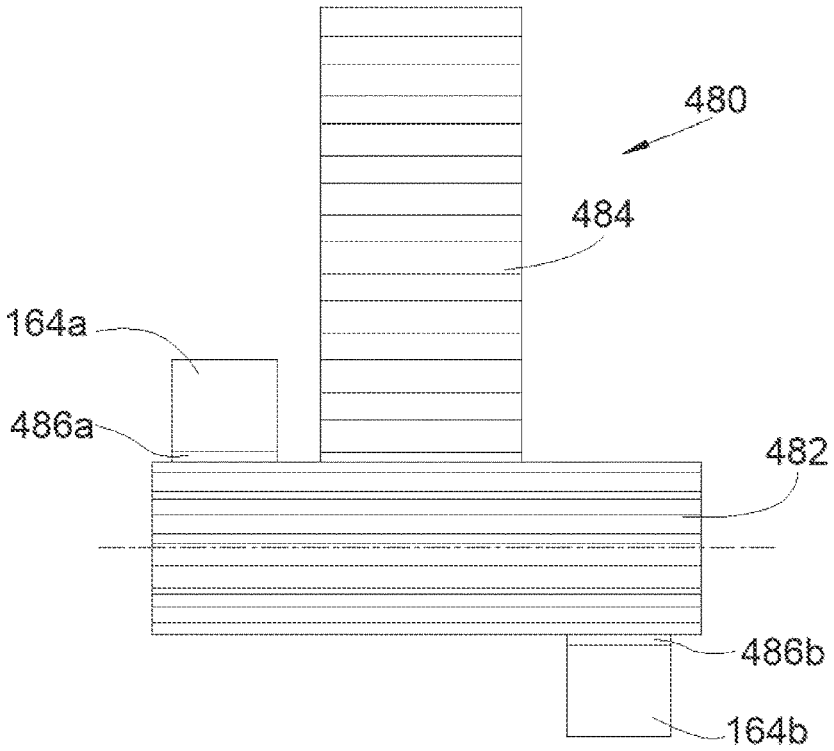
FIG. 4 is a view in the direction of the arrow F in FIG. 1 for a third variant of the first embodiment of the invention.

FIGS. 2, 3 and 4 show different variants of the movement transformation system 280, 380, 480 in accordance with the first embodiment of the invention. Each movement transformation system 280, 380, 480 includes a pinion 282, 382, 482, the rotation axis of which is horizontal and perpendicular to the direction of movement in translation of the piston 162. The pinion 282, 382, 482 is mounted to be mobile in rotation on the chassis 101. Each movement transformation system 280, 380, 480 also includes a first rack 284, 384, 484 and a second rack 286, 386*a-b*, 486*a-b*.

In the embodiment of the invention presented here, the pinion 282, 382, 482 and the first rack 284, 384, 484 are common to all the movement transformation systems 280, 380, 480 employed in one particular embodiment.

The slider 104 carries the first rack 284, 384, 484, which meshes with the pinion 282, 382, 482. The first rack 284, 384, 484 is secured to the slider 104.

Each piston 162, and more particularly the associated piston rod 164, carries the second rack 286, 386*a-b*, 486*a-b* which meshes with the pinion 282, 382, 482. Each second rack 286, 386*a-b*, 486*a-b* is secured to the corresponding piston 162.

Accordingly, vertical movement of the slider 104 drives movement of the first rack 284, 384, 484, which then drives the rotation of the pinion 282, 382, 482, which then drives the movement of the second rack 286, 386*a-b*, 486*a-b* and therefore of the piston 162.

Because of the simultaneous movement of the slider 104, the piston 162 and the piston rod 164, and to prevent these elements telescoping when moving, they are offset relative to one another along the rotation axis of the pinion 282, 382, 482.

In each of the embodiments presented in FIGS. 2 to 4 the first rack 284, 384, 484 meshes with a lateral part of the pinion 282 and, more particularly, the lateral part facing the press 102.

In the FIG. 2 embodiment, there is only one piston 162 and therefore only one piston rod 164 and the second rack 286 meshes with a lower part of the pinion 282, which makes it possible to place the container 152 on the opposite side of the press 102 to the pinion 162.

In the FIG. 3 embodiment, there are two pistons 162 and therefore two piston rods 164*a-b*, and each second rack 386*a-b* meshes with a lower part of the pinion 382, which makes it possible to place the container 152 on the opposite side of the press 102 to the pinion 382. The movement of first rack 384 drives the movement of the two second racks 386*a-b* in the same direction.

In the FIG. 4 embodiment there are two pistons 162 and therefore two piston rods 164*a-b* and one of the second racks 486*a* meshes with a lower part of the pinion 482 and the other of the second racks 486*b* meshes with an upper part of the pinion 482, which makes it possible to place a container 152 on each side of the pinion 482. The movement of the first rack 384 drives the movement of the two second racks 486*a-b* in opposite directions.

For reasons of balance, when there are two pistons 162 the two second racks 386*a-b*, 486*a-b* are disposed on either side of the first rack 384, 484.

Moreover, using a rack-and-pinion system enables reduction of losses by friction.

In the second embodiment of the invention (FIG. 5) there are two containers 552*a-b* and a movement transformation system 580*a-b* for each container 552*a-b*, but there could be only one container and therefore only one movement transformation system.

The movement transformation system 580*a-b* includes an arm 582*a-b* that has a first end that is mounted in articulated manner on the slider 504 and a second end that is mounted in articulated manner on the piston 562*a-b* and, more particularly, on the piston rod 564*a-b*.

The length of the arm 582*a-b* is preferably determined so that when the slider 504 is in its first position, and the piston 562*a-b* is in the away position, the arm 582*a-b* is at a non-flat angle to the direction of movement of the piston 562*a-b* and so that when the slider 504 is in its second position, and the piston 562*a-b* is in the close position, the arm 582*a-b* is at a flat angle to the direction of movement of the piston 562*a-b*, that is to say, the arm 582*a-b* and the direction of movement of the piston 562*a-b* are aligned.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. An extrusion system comprising:

a press with a chassis, a slider mounted to be mobile vertically on the chassis, and an actuating means that moves the slider alternately downward and upward, a hollow container for receiving a billet, the hollow container having an extrusion die at one end and a piston mounted at an opposite end, the piston being mobile in translation horizontally in the hollow container, and a movement transformation system arranged between the slider and the piston to transform a vertical movement in translation of the slider into a horizontal movement in translation of the piston.

2. The extrusion system according to claim 1, wherein the movement transformation system comprises:

a pinion rotational about an axis of rotation, the axis of rotation perpendicular to a direction of movement in translation of the piston, a first rack meshed with the pinion and secured to the slider, and a second rack meshed with the pinion and secured to said piston.

3. The extrusion system according to claim 2, wherein the second rack meshes with a part of the pinion below the axis of rotation of the pinion.

4. The extrusion system according to claim 2, further comprising:

a second piston, and a third rack meshed with the pinion and secured to the second piston, wherein the third rack meshes with a part of the pinion below the axis of rotation of the pinion.

5. The extrusion system according to claim 2, further comprising:

a second piston, and a third rack meshed with the pinion and secured to the second piston, wherein the second rack meshes with a part of the pinion below the axis of rotation of the pinion, and wherein the third rack meshes with a part of the pinion above the axis of rotation of the pinion.

6. The extrusion system according to claim 1, wherein the movement transformation system includes an arm having a first end mounted in an articulated manner on the slider and a second end mounted in an articulated manner on the piston.

* * * * *